US008559835B2

(12) United States Patent
Hirobe

(10) Patent No.: US 8,559,835 B2
(45) Date of Patent: Oct. 15, 2013

(54) IMAGE FORMING APPARATUS CAPABLE OF MEASURING AN AMOUNT OF ADHERED TONER AND CONTROLLING AN IMAGE DENSITY

(75) Inventor: Fumitake Hirobe, Ushiku (JP)

(73) Assignee: Canon Kabushiki Kaisha, Tokyo (JP)

( * ) Notice: Subject to any disclaimer, the term of this patent is extended or adjusted under 35 U.S.C. 154(b) by 443 days.

(21) Appl. No.: 13/025,560

(22) Filed: Feb. 11, 2011

(65) Prior Publication Data

US 2011/0200347 A1 Aug. 18, 2011

(30) Foreign Application Priority Data

Feb. 18, 2010 (JP) ..... 2010-033851

(51) Int. Cl.
*G03G 15/00* (2006.01)

(52) U.S. Cl.
USPC ..... 399/49

(58) Field of Classification Search
USPC ..... 399/15, 49–51, 66, 72, 74
See application file for complete search history.

(56) References Cited

U.S. PATENT DOCUMENTS

| | | | | |
|---|---|---|---|---|
| 8,213,820 | B2 * | 7/2012 | Atsumi et al. | 399/74 |
| 8,355,643 | B2 * | 1/2013 | Kojima et al. | 399/49 |
| 2011/0293302 | A1 * | 12/2011 | Aoki | 399/49 |

FOREIGN PATENT DOCUMENTS

| | | | |
|---|---|---|---|
| JP | 4-156479 | A | 5/1992 |
| JP | 2010-049233 | A | 3/2010 |

* cited by examiner

*Primary Examiner* — William J Royer
(74) *Attorney, Agent, or Firm* — Canon USA, Inc., IP Division

(57) ABSTRACT

An image forming apparatus includes an image forming unit configured to form a toner image on an image bearing member, a first detection unit configured to detect a height of the toner image formed according to a predetermined image forming condition by the image forming unit, a determination unit configured to determine an image forming condition of the image forming unit according to a detection result of the first detection unit, a second detection unit configured to detect a density of the toner image formed according to a predetermined image forming condition by the image forming unit, and a correction unit configured to correct the image forming condition of the image forming unit determined by the determination unit based on the density of the toner image detected by the second detection unit.

9 Claims, 8 Drawing Sheets

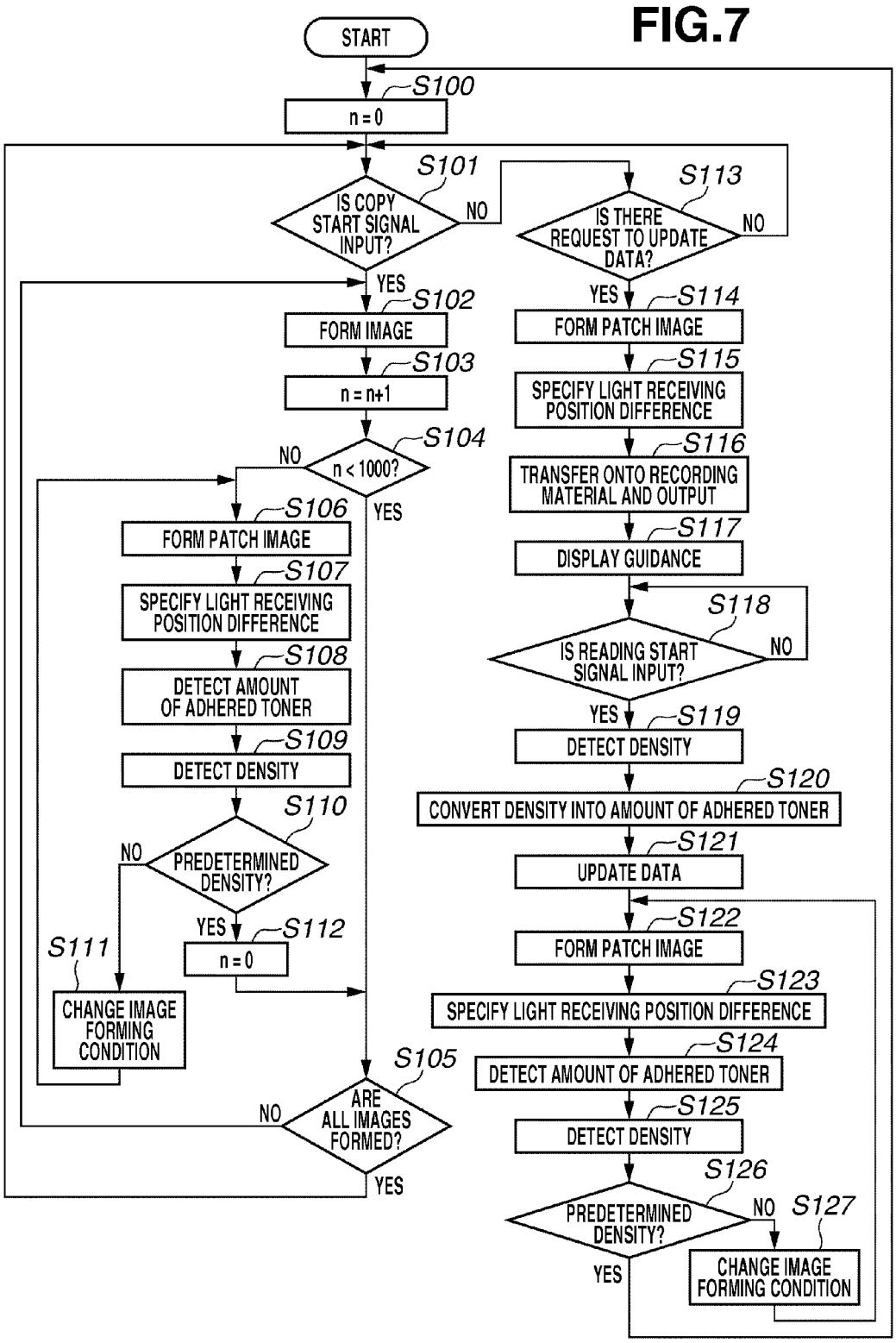
FIG.7
START
S100
n = 0
S101
IS COPY START SIGNAL INPUT?
NO
YES
S102
FORM IMAGE
S103
n = n+1
S104
n < 1000?
NO
YES
S106
FORM PATCH IMAGE
S107
SPECIFY LIGHT RECEIVING POSITION DIFFERENCE
S108
DETECT AMOUNT OF ADHERED TONER
S109
DETECT DENSITY
S110
PREDETERMINED DENSITY?
NO
YES
S112
n = 0
S111
CHANGE IMAGE FORMING CONDITION
S105
ARE ALL IMAGES FORMED?
NO
YES
S113
IS THERE REQUEST TO UPDATE DATA?
NO
YES
S114
FORM PATCH IMAGE
S115
SPECIFY LIGHT RECEIVING POSITION DIFFERENCE
S116
TRANSFER ONTO RECORDING MATERIAL AND OUTPUT
S117
DISPLAY GUIDANCE
S118
IS READING START SIGNAL INPUT?
NO
YES
S119
DETECT DENSITY
S120
CONVERT DENSITY INTO AMOUNT OF ADHERED TONER
S121
UPDATE DATA
S122
FORM PATCH IMAGE
S123
SPECIFY LIGHT RECEIVING POSITION DIFFERENCE
S124
DETECT AMOUNT OF ADHERED TONER
S125
DETECT DENSITY
S126
PREDETERMINED DENSITY?
NO
YES
S127
CHANGE IMAGE FORMING CONDITION

IMAGE FORMING APPARATUS CAPABLE OF MEASURING AN AMOUNT OF ADHERED TONER AND CONTROLLING AN IMAGE DENSITY

BACKGROUND OF THE INVENTION

1. Field of the Invention

The present invention relates to an image forming apparatus using an electrophotographic method, such as a copying machine, a laser printer, or a facsimile, and more particularly, to measurement of an amount of adhered toner and control of an image density.

2. Description of the Related Art

In a method for controlling a density of an image formed by an image forming apparatus using an electrophotographic method, a toner image to be used for density detection is formed on a photosensitive drum or an intermediate transfer belt, and an image forming condition is feedback-controlled based on a density detected from the toner image.

The image forming condition includes a charging bias of a photosensitive drum bearing a charged toner, an amount of exposure light for controlling a density of the charged toner borne by the photosensitive drum, and a transfer voltage for transferring a toner image borne by the photosensitive drum or the intermediate transfer belt onto a recording material such as paper. If the image forming condition is determined, a density of the toner image transferred onto the recording material is determined.

In recent years, the height of the toner image borne by the photosensitive drum or the intermediate transfer belt has been able to be detected with high precision. A method for detecting a density of the toner image from the detected height of the toner image has been proposed. The density of the toner image changes depending on an amount of toner borne per unit area (an amount of adhered toner).

More specifically, if the amount of adhered toner is increased to form a toner image having a high density, the height of the toner image is also increased. If the amount of adhered toner is decreased to form a toner image having a low density, the height of the toner image is also decreased. Therefore, the density of the toner image can be detected by detecting the height of the toner image.

Japanese Patent Application Laid-Open No. 4-156479 discusses irradiating a toner image for density detection borne by a photosensitive drum or an intermediate transfer belt with light, and measuring the height of the toner image from a light receiving position on a line sensor for receiving light reflected from the toner image. The measured height of the toner image is converted into a density of the toner image by referring to data representing a correspondence relationship between a height and a density, which is previously stored.

However, in such an image forming apparatus, if a charge amount of toner in a developing unit changes due to an environmental variation such as temperature and humidity, deterioration of a developer that is a mixture of toner and magnetic carrier, or the like, a density of a toner image to be formed cannot be controlled with high precision because a correspondence relationship between the height of the toner image borne by the photosensitive drum or the intermediate transfer belt and a density of an image output from the image forming apparatus changes.

A case where a toner image having a predetermined height corresponding to a predetermined density is formed while an image forming condition is determined using a conventional method will be described below.

In a toner image developed using toner having a small charge amount, a density of the toner forming the toner image becomes high because a repulsive force exerted between its toner particles becomes low. Therefore, a toner image having the toner having a small charge amount borne thereon to a predetermined height is output as an image having a density higher than a predetermined density.

In a toner image developed using toner having a large charge amount, a density of the toner forming the toner image becomes low because a repulsive force exerted between its toner particles becomes high. Therefore, a toner image having the toner having a large charge amount borne thereon to a predetermined height is output as an image having a density lower than a predetermined density.

SUMMARY OF THE INVENTION

The present invention is directed to an image forming apparatus capable of forming a toner image having an appropriate density even when a toner charge amount changes.

According to an aspect of the present invention, an image forming apparatus includes an image forming unit configured to form a toner image on an image bearing member, a first detection unit configured to detect a height of the toner image formed according to a predetermined image forming condition by the image forming unit, the height of the toner image being a height in a direction perpendicular to a surface of the image bearing member, a determination unit configured to determine an image forming condition of the image forming unit according to a detection result of the first detection unit, a second detection unit configured to detect a density of the toner image formed according to the predetermined image forming condition by the image forming unit, and a correction unit configured to correct the image forming condition of the image forming unit determined by the determination unit based on the density of the toner image detected by the second detection unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 7 is a flowchart illustrating image forming processing according to the first exemplary embodiment.

DESCRIPTION OF THE EMBODIMENTS

Various exemplary embodiments, features, and aspects of the invention will be described in detail below with reference to the drawings.

Figure 1:
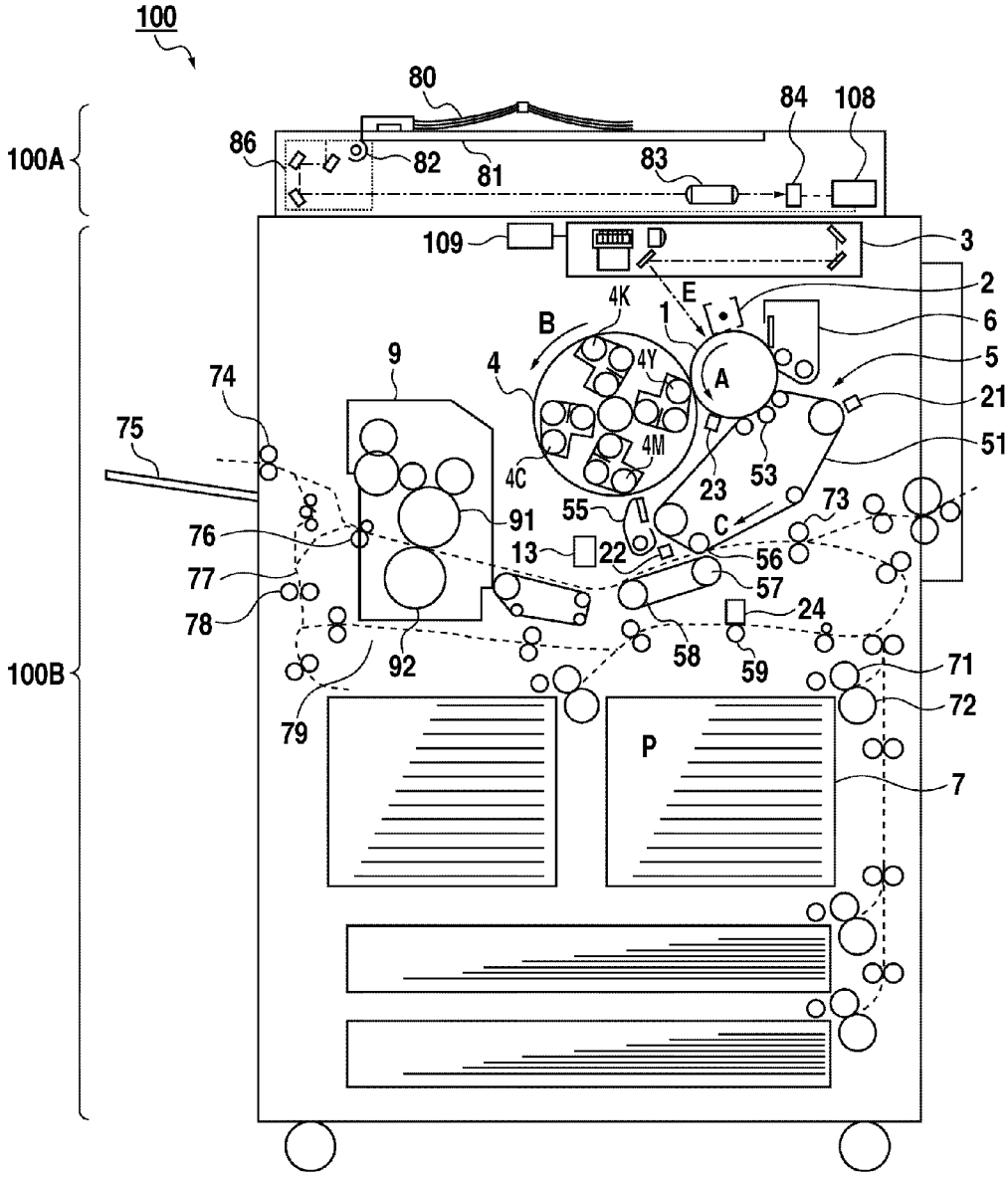
FIG. 1 is a schematic sectional view illustrating an image forming apparatus.

FIG. 1 illustrates an image forming apparatus 100 according to the present exemplary embodiment. The image forming apparatus 100 includes a printer unit 100B, and a reader unit 100A mounted on the printer unit 100B.

The reader unit 100A includes a document positioning glass 81 on which a document 80 is laid, an exposure lamp 82 for scanning an image of the document 80 laid on the document positioning glass 81, and an image scanning unit 86 including a mirror. The exposure lamp 82 irradiates the document 80 with light in the process of the image scanning unit 86 moving on a lower surface of the document positioning glass 81.

A short focus lens array 83 condenses light reflected from the document 80. The condensed light is reflected by the mirror in the image scanning unit 86, and is read by a full color sensor 84 such as a charge coupled device (CCD). The light read by the full color sensor 84 is color-separated by an image processing unit 108 into yellow, cyan, magenta, and black color components, and is converted into image signals for the color components.

The printer unit 100B includes a photosensitive drum 1 that is driven to rotate in a direction indicated by an arrow A. Around the photosensitive drum 1, a charging device 2, an exposure device 3, a developing device 4, a transfer device 5, a drum cleaner 6, and the like are arranged in this order in its rotational direction.

The charging device 2 is a corona charging device for charging the photosensitive drumlin a non-contact manner. The charging device 2 may be a contact-type charging device such as a conductive charging roller, charging brush, or a magnetic brush provided in contact with or in close proximity to the photosensitive drum 1.

The exposure device 3 irradiates the charged photosensitive drum 1 with exposure light E according to an image signal. Thus, electrostatic latent images corresponding to the document 80 are sequentially formed for each color component on a surface of the photosensitive drum 1.

The developing device 4 includes a rotary unit, which is a combination of developing units 4Y, 4M, 4C, and 4K respectively containing yellow, magenta, cyan, and black developers, rotating in a direction indicated by an arrow B. The developing unit 4Y contains the yellow developer, the developing unit 4M contains the magenta developer, the developing unit 4C contains the cyan developer, and the developing unit 4K contains the black developer.

When the electrostatic latent image is developed, the rotary unit in the developing device 4 rotates in the direction indicated by the arrow B so that the developing unit 4Y, 4M, 4C, and 4K in the color served for development is moved to a development position in close proximity to the surface of the photosensitive drum 1, and the electrostatic latent image is visualized as a toner image.

The transfer device 5 includes an intermediate transfer belt 51, a primary transfer roller 53, a roller 56, and a secondary transfer roller 57. The intermediate transfer belt 51 is an endless image bearing member that is driven to rotate in a direction indicated by an arrow C. The primary transfer roller 53 presses the photosensitive drum 1 via the intermediate transfer belt 51, to form a first nip portion. The secondary transfer roller 57 presses the roller 56 via the intermediate transfer belt 51, to form a second nip portion.

In the first nip portion, the toner image formed on the photosensitive drum 1 is transferred onto the intermediate transfer belt 51 from the photosensitive drum 1. In the second nip portion, the toner image borne by the intermediate transfer belt 51 is transferred onto a recording material P from the intermediate transfer belt 51.

A belt cleaner 55 for removing toner, which remains on the intermediate transfer belt 51 without being transferred onto the recording material P from the intermediate transfer belt 51, is disposed on the downstream side of the second nip portion in a movement direction of the intermediate transfer belt 51.

The drum cleaner 6 for removing toner, which remains on the photosensitive drum 1 without being transferred onto the intermediate transfer belt 51 from the photosensitive drum 1, is disposed on the downstream side of the first nip portion in the rotational direction of the photosensitive drum 1.

The printer unit 100B includes a sheet cassette 7 containing the above-mentioned recording material P, an environment sensor 13 for detecting temperature and humidity in the image forming apparatus 100, a conveyance belt 58 for conveying the recording material P, on which a toner image has been transferred, from the second nip portion, and a fixing device 9 for fixing the toner image on the recording material P.

The printer unit 100B further includes a toner height sensor unit 21 for irradiating a patch image, which has been transferred onto the intermediate transfer belt 51, with measuring light, and detecting the height (toner height) of the patch image based on a position on a light receiving surface on which its reflected light is received.

An image forming operation for the image forming apparatus 100 according to the present exemplary embodiment to form a toner image based on the document 80 will be described below.

The charging device 2 uniformly charges the surface of the photosensitive drum 1. Then, the exposure device 3 irradiates the exposure light E, which has been modulated according to an image signal containing a yellow component output from the reader unit 100A, onto the photosensitive drum 1. Thus, an electrostatic latent image corresponding to an image containing a yellow component of the document 80 is formed on the surface of the photosensitive drum 1.

The developing device 4 then rotates in the direction indicated by the arrow. B, to move the developing unit 4Y to the development position. The developing unit 4Y visualizes the electrostatic latent image formed on the photosensitive drum 1 as a yellow toner image.

When the yellow toner image then enters the first nip portion as the photosensitive drum 1 rotates in the direction indicated by the arrow A, the primary transfer roller 53 applies a transfer voltage thereto. Thus, the yellow toner image on the photosensitive drum 1 is transferred onto the intermediate transfer belt 51. The drum cleaner 6 removes toner, which remains on the photosensitive drum 1 without being transferred onto the intermediate transfer belt 51.

The charging device 2 then uniformly charges the surface of the photosensitive drum 1. The exposure device 3 then exposes the photosensitive drum 1 with the exposure light E, which has been modulated according to an image signal containing a magenta component output from the reader unit 100A. Thus, an electrostatic latent image corresponding to an image containing a magenta component of the document 80 is formed on the surface of the photosensitive drum 1.

The developing device 4 then rotates in the direction indicated by the arrow B, to move the developing unit 4M to a development position. The developing unit 4M visualizes the electrostatic latent image formed on the photosensitive drum 1 as a magenta toner image.

The photosensitive drum 1 then rotates in the direction indicated by the arrow A, to convey the magenta toner image to the first nip portion. The intermediate transfer belt 51 rotates in the direction indicated by the arrow C, to convey the yellow toner image to the first nip portion.

When the magenta toner image enters the second nip portion to overlap the yellow toner image borne by the intermediate transfer belt 51, the primary transfer roller 53 applies a transfer voltage thereto. Thus, the magenta toner image is superposed on and transferred onto the yellow toner image.

Similarly, a cyan toner image and a black toner image are sequentially formed on the photosensitive drum 1, and are sequentially superposed on and transferred onto the magenta toner image in the first nip portion. Thus, a full color toner image is formed on the intermediate transfer belt 51.

The secondary transfer roller 57 does not apply a transfer voltage until the toner images in the respective colors are sequentially superposed on the intermediate transfer belt 51, to form the full color toner image. Therefore, the toner images borne by the intermediate transfer belt 51 and conveyed continue to be borne by the intermediate transfer belt 51 until they become the full color toner image.

The belt cleaner 55 is spaced apart from the intermediate transfer belt 51 by the existing configuration. Therefore, the toner images in the respective colors to be transferred onto the intermediate transfer belt 51 are not removed by the belt cleaner 55 until they have been transferred onto the recording material P.

The full color toner image formed on the intermediate transfer belt 51 is conveyed to the second nip portion as the intermediate transfer belt 51 rotates in the direction indicated by the arrow C.

Sheet feeding rollers 71 and 72 send recording materials P one at a time from the sheet cassette 7. The recording material P is conveyed to a registration roller 73 after passing through a conveyance path, indicated by a broken line. The recording material P, which has been conveyed to the registration roller 73, is sent to the second nip portion to contact the full color toner image after its timing is adjusted.

A transfer voltage is applied to the secondary transfer roller 57 according to the timing at which the full color toner image on the intermediate transfer belt 51 and the recording material P enter the second nip portion. Thus, the full color toner image on the intermediate transfer belt 51 is transferred onto the recording material P. The belt cleaner 55 removes toner, which remains on the intermediate transfer belt 51 without being transferred onto the recording material P.

The conveyance belt 58 conveys the recording material P bearing the toner image to the fixing device 9 so that a toner image is fixed while being sandwiched between fixing rollers 91 and 92, which have been heated by a heater (not illustrated), and conveyed. Then, a sheet discharge roller 74 discharges the recording material P, on which the toner image has been fixed, onto a sheet discharge tray 75.

Figure 2:
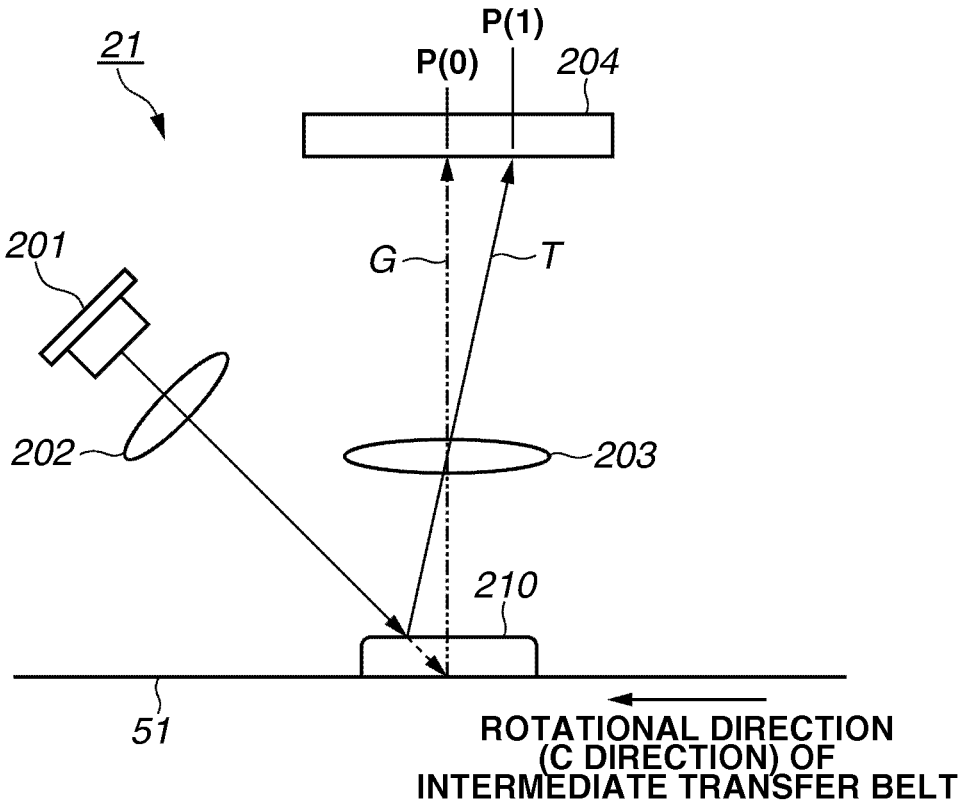
FIG. 2 is a schematic view illustrating a principal part of a toner height sensor unit according to a first exemplary embodiment.

FIG. 2 is a schematic view illustrating a principal part of the toner height sensor unit 21 according to the present exemplary embodiment.

A laser oscillator 201 irradiates the intermediate transfer belt 51 with measuring light (a wavelength of 780 nm) via a condenser lens 202. The measuring light irradiated by the laser oscillator 201 has a spot diameter of 50 μm on the intermediate transfer belt 51. A position where the measuring light is irradiated is hereinafter referred to as an irradiation position.

A line sensor 204 includes a large number of light receiving elements arranged in a line. Each of the light receiving elements in the line sensor 204 outputs, when it receives light, a voltage corresponding to the intensity of the light. The light receiving elements are spaced apart from one another so that a change in a light receiving position can be detected from light reflected from a patch image 210 even when the patch image 210 changes by an amount corresponding to one toner particle having an average particle diameter.

A sensor that receives the light reflected from the patch image 210 may be an area sensor including light receiving elements arranged in a two-dimensional manner. In the present exemplary embodiment, the toner height sensor unit 21 functions as a first detection unit.

A method for receiving light reflected from the intermediate transfer belt 51 and light reflected from the patch image 210 by the toner height sensor unit 21 will be described below.

The laser oscillator 201 first irradiates the intermediate transfer belt 51 with the measuring light while the patch image 210 does not reach the irradiation position. The intermediate transfer belt 51 is irradiated with the measuring light from the laser oscillator 201 via the condenser lens 202, and is reflected from a surface of the intermediate transfer belt 51.

The light reflected from the surface of the intermediate transfer belt 51 forms an image on a light receiving position P(0) on the line sensor 204 via a light receiving lens 203. An arrow G indicates, out of lights reflected from the intermediate transfer belt 51, the light that passes through the center of the light receiving lens 203. The reflected light, which cannot be incident on the light receiving lens 203, is blocked by a shielding plate (not illustrated).

When the intermediate transfer belt 51 moves in the direction indicated by the arrow C, the patch image 210 reaches the irradiation position. At this time, the measuring light irradiated by the laser oscillator 201 is reflected from the surface of the patch image 210. The light reflected from the surface of the patch image 210 forms an image on a light receiving position P(1) on the line sensor 204 via the light receiving lens 203. More specifically, the light receiving position P(1) of the light reflected from the patch image 210 differs from the light receiving position P(0).

An arrow T indicates, out of lights reflected from the patch image 210, the light that passes through the center of the light receiving lens 203. The reflected light, which cannot be incident on the light receiving lens 203, is blocked by a shielding plate (not illustrated).

A method for specifying the light receiving position P(0) of the light reflected from the intermediate transfer belt 51 and the light receiving position P(1) of the light reflected from the patch image 210 will be described below.

Figure 3:
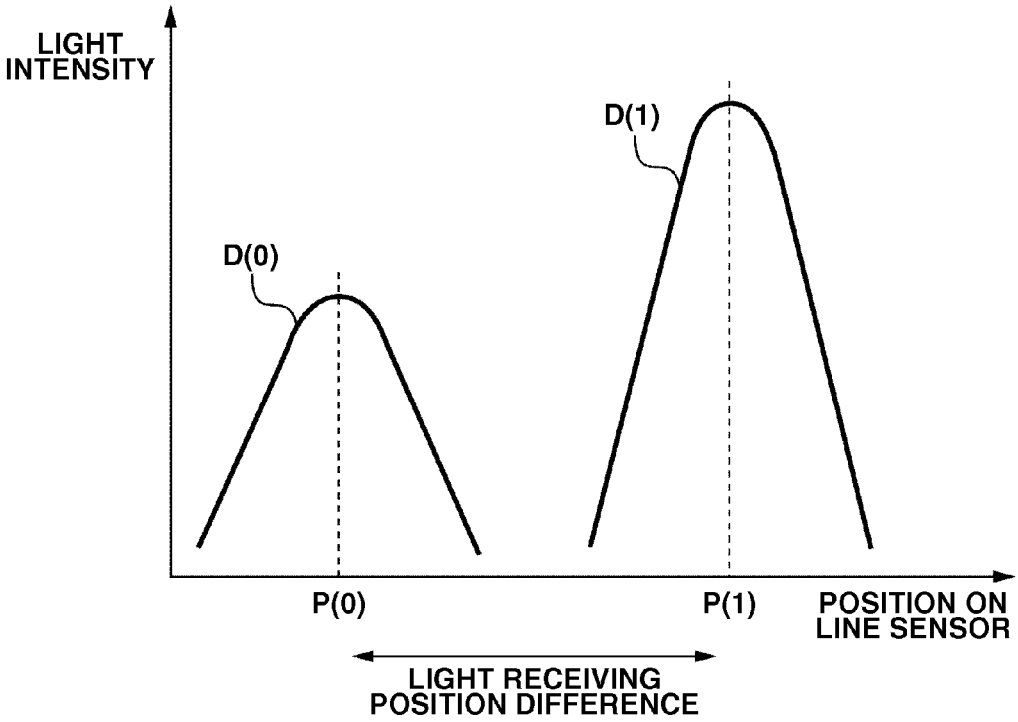
FIG. 3 illustrates a light intensity distribution of a patch image measured by the toner height sensor unit according to the first exemplary embodiment.

FIG. 3 illustrates a light intensity distribution D(0) of the light reflected from the surface of the intermediate transfer belt 51 and a light intensity distribution D(1) of the light reflected from the surface of the patch image 210, which have been measured by the line sensor 204.

The light receiving position P(0) of the light reflected from the intermediate transfer belt 51 is a position on the line sensor 204 at which the light intensity of the light reflected from the intermediate transfer belt 51 reaches its maximum value.

In the present exemplary embodiment, a first signal represents the light receiving position P(0) on the line sensor 204. The light receiving position P(1) of the light reflected from the patch image 210 is a position on the line sensor 204 at which the light intensity of the light reflected from the patch image 210 reaches its maximum value. In the present exemplary embodiment, a second signal represents the light receiving position P(1) on the line sensor 204.

A difference ΔP(1) between the light receiving position P(0) of the light reflected from the intermediate transfer belt 51 and the light receiving position P(1) of the light reflected from the patch image 210 increases as the toner height of the patch image 210 increases, and decreases as it decreases. The light receiving position difference ΔP(1) is obtained by using an equation (1):

$$\Delta P(1)=P(1)-P(0) \quad (1)$$

The toner height sensor unit 21 according to the present exemplary embodiment may specify the light receiving position difference ΔP(1) without measuring the light receiving position P(0) of the light reflected from the intermediate transfer belt 51. In this configuration, the line sensor 204 is arranged to receive the light reflected from the intermediate transfer belt 51 at a reference position on the line sensor 204.

Thus, the toner height sensor unit 21 irradiates the patch image 210 with light, detects the light receiving position P(1) of light reflected from the patch image 210, and then specifies the light receiving position difference ΔP(1) from a difference between the light receiving position P(1) and the reference position.

Figure 4A:
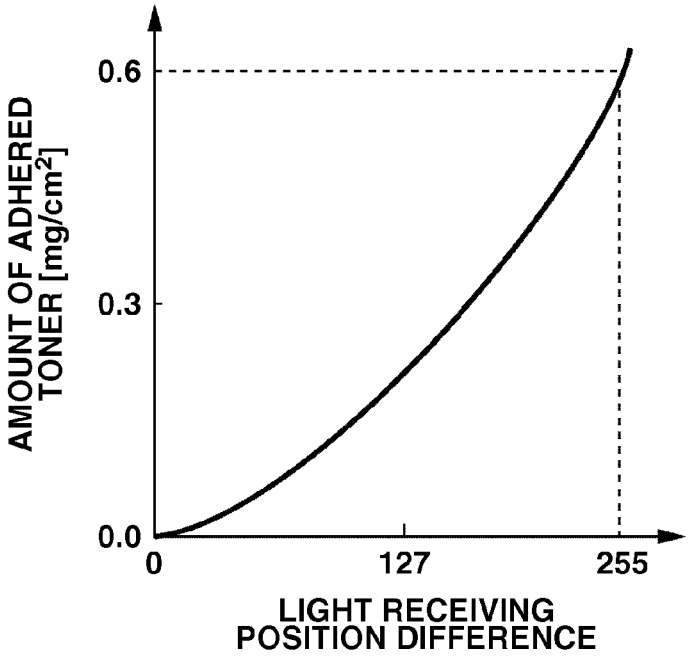
FIG. 4A illustrates a correspondence relationship between a light receiving position difference and an amount of adhered toner.
Figure 4B:
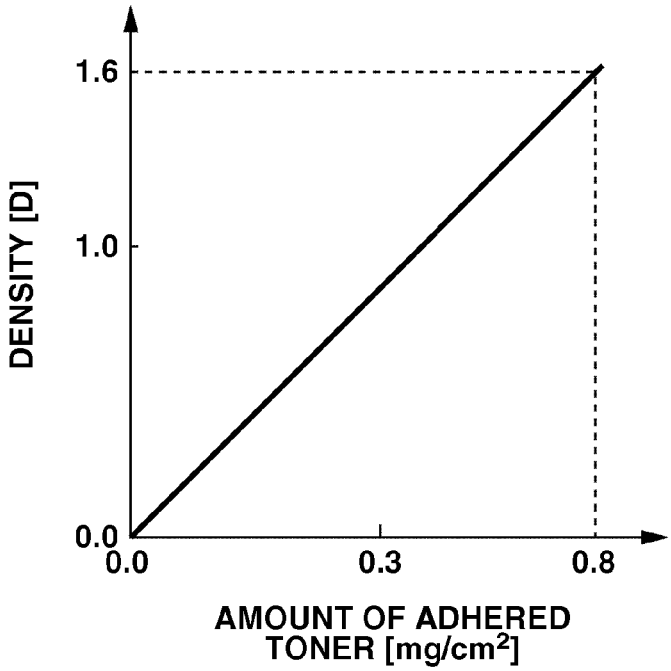
FIG. 4B illustrates a correspondence relationship between an amount of adhered toner and a density.

A method for detecting density of the patch image 210 from the light receiving position difference ΔP(1) specified by the toner height sensor unit 21 will be described below. FIG. 4A illustrates data representing a correspondence relationship between a light receiving position difference and an amount of adhered toner. FIG. 4B illustrates data representing a correspondence relationship between an amount of adhered toner and density. The amount of adhered toner is an amount of toner borne per unit area.

The light receiving position difference ΔP(1) for the patch image 210 is converted into an amount of adhered toner Q in the patch image 210 by referring to data representing a correspondence relationship between a light receiving position difference and an amount of adhered toner, illustrated in FIG. 4A. The amount of adhered toner Q is converted into the density of the patch image 210 by referring to data representing a correspondence relationship between an amount of adhered toner and density, illustrated in FIG. 4B.

Even if an amount of adhered toner Q corresponding to a predetermined density is always identical, however, a light receiving position difference ΔP(1) detected from a toner image having a predetermined amount of adhered toner Q changes due to an environmental variation or deterioration of a developer.

Even if the amount of adhered toner Q is always identical, the light receiving position difference ΔP(1) detected by the toner height sensor unit 21 changes for the following reason.

Figure 5:
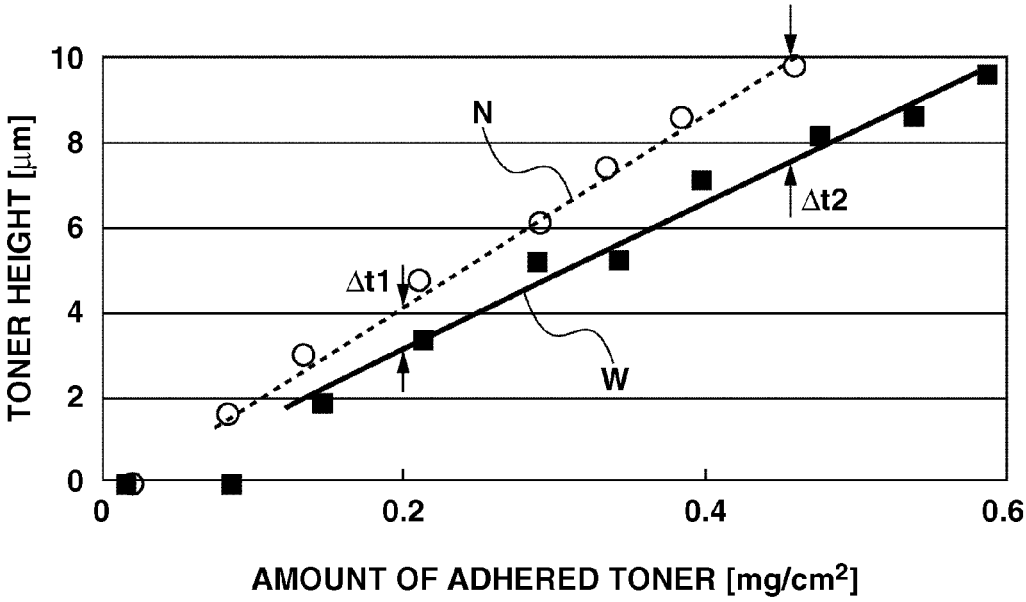
FIG. 5 illustrates a change in a toner height due to a difference in a toner charge amount.

FIG. 5 illustrates toner heights of toner images respectively formed using toners, which differ in charge amounts.

A broken line N is data representing a relationship between an amount of adhered toner to a toner image formed using a new developer that has been agitated for a predetermined period of time and a toner height of the toner image. A solid line W is data representing a relationship between an amount of adhered toner to a toner image formed after development of 100,000 sheets and a toner height of the toner image. When the image forming apparatus 100 according to the present exemplary embodiment forms a toner image at a maximum density (a density of 1.6 measured by X-Rite 530 Spectrodensitometer manufactured by X-Rite Cooperation), an amount of adhered toner to the toner image is 0.6 mg/cm$^2$.

In FIG. 5, when toner images having the same amount of adhered toner are formed, the toner height (the solid line W) of the toner image formed after development of 100,000 sheets is smaller than the toner height (the broken line N) of the toner image formed using the new developer. In FIG. 5, a variation amount Δt1 in a toner height between halftone images having the same amount of adhered toner (an amount of adhered toner of 0.2 mg/cm$^2$) is smaller than a variation amount Δt2 in a toner height between high density images having the same amount of adhered toner (an amount of adhered toner of 0.45 mg/cm$^2$).

Therefore, the toner images differ in the toner height even if they are the same in the amount of adhered toner, and thus differ in the light receiving position difference ΔP(1) measured by the toner height sensor unit 21.

In the present exemplary embodiment, the data representing a correspondence relationship between a light receiving position difference and an amount of adhered toner (FIG. 4A) is corrected so that a density is detected with high precision from a light receiving position difference measured by the toner height sensor unit 21.

The data representing a correspondence relationship between a light receiving position difference and an amount of adhered toner (FIG. 4A) is referred to as first data, and the data representing a correspondence relationship between an amount of adhered toner and density (FIG. 4B) is referred to as second data. The first data and the second data are provided for each of the color components.

Processing for correcting the first data by the image forming apparatus 100 according to the present exemplary embodiment will be described below with reference to FIGS. 6 and 7.

In the image forming apparatus 100 according to the present exemplary embodiment, density of an image is represented at 256 gray levels (0 to 255). When a density of a patch image is detected and when first data is corrected, 16 patch images are formed for each of the color components. Densities of the 16 patch images are 15, 31, . . . , 239, 255 increasing with every 16 levels.

16 yellow patch images T(Ya), T(Yb), . . . , T(Yp) are hereinafter collectively referred to as T(Yx), where a, b, . . . , p respectively mean that density levels are 15, 31, . . . , 255.

Similarly, magenta patch images T(Ma), T(Mb), . . . , T(Mp) are collectively referred to as T(Mx), cyan patch images T(Ca), T(Cb), . . . , T(Cp) are collectively referred to as T(Cx), and black patch images T(Ka), T(Kb), . . . , T(Kp) are collectively referred to as T(Kx).

While the number of patch images and the density levels thereof are determined, as needed, they are not limited to those in the present exemplary embodiment.

Figure 6:
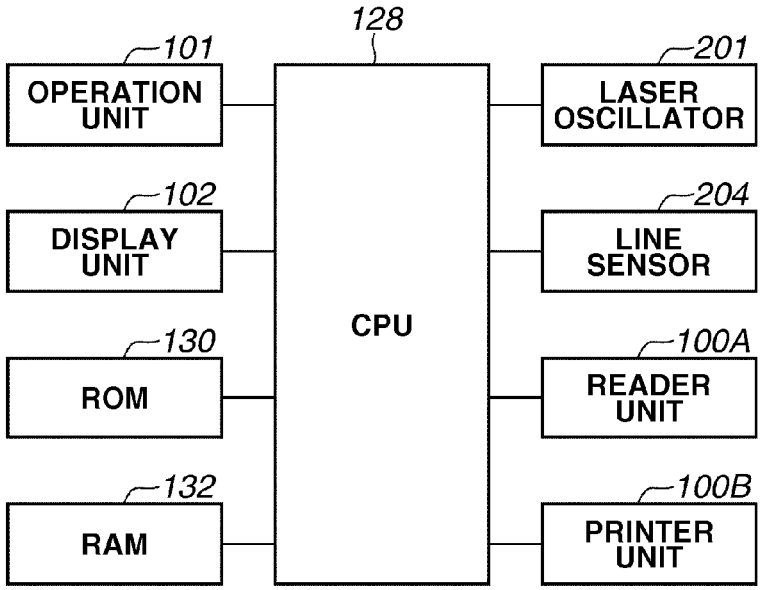
FIG. 6 is a control block diagram of an image forming apparatus according to the first exemplary embodiment.

FIG. 6 is a control block diagram of the image forming apparatus 100 according to the present exemplary embodiment.

A central processing unit (CPU) 128 is a control circuit for controlling the image forming apparatus 100. A read-only memory (ROM) 130 stores a control program for controlling various types of processing performed by the image forming apparatus 100. The ROM 130 stores an image forming condition of a patch image formed when the first data is corrected. The ROM 130 stores the first data and the second data.

The ROM 130 stores the image forming condition of the patch image formed when the first data is corrected. A random access memory (RAM) 132 is a system work memory used for the CPU 128 to perform processing.

The image forming condition includes a charging bias for the charging device 2 to charge the photosensitive drum 1, an exposure intensity and an exposure time of exposure light E irradiated by the exposure device 3, a developing bias applied between each of the developing units 4Y, 4M, 4C, and 4K and the photosensitive drum 1, and transfer voltages applied from the primary transfer roller 53 and the secondary transfer roller 57. The first data and the second data are stored in the RAM 132 immediately after a main power supply is turned on.

The laser oscillator 201 irradiates the intermediate transfer belt 51 with measuring light in response to a signal from the CPU 128.

Since the line sensor 204 has been described in FIG. 2, the description thereof is not repeated. The reader unit 100A reads the document 80 or the recording material P on which patch images T(Yx), T(Mx), T(Cx), and T(Kx) have been transferred (hereinafter referred to as a test chart), and outputs image signals for the respective color components to the CPU 128. In the present exemplary embodiment, the reader unit 100A functions as a second detection unit.

The printer unit 100B forms a toner image corresponding to the image signal in response to the signal from the CPU 128. The printer unit 100B forms, when a signal for forming a patch image is input thereto from the CPU 128, the patch images T(Yx), T(Mx), T(Cx), and T(Kx) using the image forming condition stored in the ROM 130 or the RAM 132.

An operation unit 101 is an operation panel (not illustrated) provided in the image forming apparatus 100 illustrated in FIG. 1. The operation unit 101 is provided with a start button. The operation unit 101 outputs a copy start signal to the CPU 128 when a user presses the start button.

The operation unit 101 outputs a signal for performing processing for correcting first data to the CPU 128 when the user performs predetermined input from the operation unit 101. The operation unit 101 may be a mouse or a keyboard of a personal computer (PC) connected to the image forming apparatus 100 via a network.

A display unit 102 is a display (not illustrated) provided in the image forming apparatus 100 illustrated in FIG. 1. The display unit 102 displays information for assisting an operation performed by the user for various types of control of the image forming apparatus 100 (hereinafter referred to as a guidance) in response to the signal from the CPU 128. The display unit 102 may be a display of the PC connected to the image forming apparatus 100 via the network.

FIG. 7 is a flowchart illustrating processing for forming an image by the image forming apparatus 100. The flowchart includes processing for correcting first data. The processing in the flowchart is performed when the CPU 128 reads out a program stored in the ROM 130.

When a main power supply of the image forming apparatus 100 is turned on, the processing proceeds to step S100. In step S100, the CPU 128 sets a count value n representing the number of sheets on which an image is formed, to zero.

In step S101, the CPU 128 then determines whether a copy start signal is input from the operation unit 101. If the copy start signal is not input from the operation unit 101 (NO in step S101), the processing proceeds to step S113.

On the other hand, if the copy start signal is input from the operation unit 101 (YES in step S101), the processing proceeds to step S102. In step S102, the CPU 128 causes the printer unit 100B to perform an image forming operation.

In the present exemplary embodiment, when the copy start signal is input once from the operation unit 101, the CPU 128 starts to form an image on a predetermined number of sheets. In this case, every time the CPU 128 performs image formation on one recording material, the processing proceeds to step S103.

Image formation on a predetermined number of sheets is referred to as an image formation job if started when the copy start signal is input once.

In step S103, the CPU 128 then increases the count value n by one. In step S104, the CPU 128 determines whether the count value n is smaller than 1000. If the count value n is smaller than 1000 (YES in step S104), the processing proceeds to step S105. In step S105, the CPU 128 determines whether formation of all images in the image formation job is completed. If the formation of all images is completed (YES in step S105), the processing proceeds to step S101.

On the other hand, if the formation of all images in the image formation job is not completed (NO in step S105), the processing proceeds to step S102 for the CPU 128 to start to form the subsequent image.

A case where the count value n is 1000 or more in step S104 will be described below. If the count value n is 1000 or more (NO in step S104), the CPU 128 performs density control, described below.

In step S106, the CPU 128 causes the printer unit 100B to form the patch images T(Yx), T(Mx), T(Cx), and T(Kx) using an image forming condition stored in the ROM 130 or the RAM 132.

In step S107, the CPU 128 then irradiates light from the laser oscillator 201, and measures a voltage output from the line sensor 204, to specify light receiving position differences ΔP(Yx), ΔP(Mx), ΔP(Cx), and ΔP(Kx) for the patch images T(Yx), T(Mx), T(Cx), and T(Kx), respectively.

The light receiving position difference ΔP(Yx) is calculated using an equation (5) from light receiving positions P(0) and P(Yx). The light receiving position P(Yx) includes light receiving positions P(Ya), P(Yb), P(Yp) of lights reflected from the yellow patch images T(Ya), T(Yb), T(Yp):

$$\Delta P(Yx)=P(Yx)-P(0)\ (x=a, b, \ldots, p) \tag{5}$$

Similarly, light receiving position differences ΔP(Mx), ΔP(Cx), and ΔP(Kx) are specified using equations (6) to (8) from light receiving positions P(Mx), P(Cx), and P(Kx) measured from the patch images T(Mx), T(Cx), and T(Kx), and the light receiving position P(0) measured from the intermediate transfer belt 51. ΔP(Mx) is a light receiving position difference for the magenta patch image T(Mx), ΔP(Cx) is alight receiving position difference for the cyan patch image T(Cx), and ΔP(Kx) is a light receiving position difference for the black patch image T(Kx).

$$\Delta P(Mx)=P(Mx)-P(0)\ (x=a, b, \ldots, p) \tag{6}$$

$$\Delta P(Cx)=P(Cx)-P(0)\ (x=a, b, \ldots, p) \tag{7}$$

$$\Delta P(Kx)=P(Kx)-P(0)\ (x=a, b, \ldots, p) \tag{8}$$

In step S108, the CPU 128 then refers to first data stored in the RAM 132 from the light receiving position differences ΔP(Yx), ΔP(Mx), ΔP(Cx), and ΔP(Kx) specified in step S107, to detect amounts of adhered toner Q(Yx), Q(Mx), Q(Cx), and Q(Kx).

The amount of adhered toner Q(Yx) includes amounts of adhered toner Q(Ya), Q(Yb), . . . , Q(Yp) of the yellow patch images T(Ya), T(Yb), . . . , T(Yp). Similarly, the amount of adhered toner Q(Mx) includes amounts of adhered toner Q(Ma), Q(Mb), . . . , Q(Mp) of the magenta patch images T(Ma), T(Mb), . . . , T(Mp). The amount of adhered toner Q(Cx) includes amounts of adhered toner Q(Ca), Q(Cb), . . . , Q(Cp) of the cyan patch images T(Ca), T(Cb), . . . , T(Cp).

The amount of adhered toner Q(Kx) includes amounts of adhered toner Q(Ka), Q(Kb), . . . , Q(Kp) of the black patch images T(Ka), T(Kb), . . . , T(Kp).

In step S109, the CPU 128 then refers to second data stored in the RAM 132 from the amounts of adhered toner Q(Yx), Q(Mx), Q(Cx), and Q(Kx) detected in step S108, to detect densities D(Yx), D(Mx), D(Cx), and D(Kx).

The density D(Yx) includes densities D(Ya), D(Yb), . . . , D(Yp) of the yellow patch images T(Ya), T(Yb), . . . , T(Yp). Similarly, the density D(Mx) includes densities D(Ma), D(Mb), . . . , D(Mp) of the magenta patch images T(Ma), T(Mb), . . . , T(Mp). The density D(Cx) includes densities D(Ca), D(Cb), . . . , D(Cp) of the cyan patch images T(Ca), T(Cb), . . . , T(Cp). The density D(Kx) includes densities D(Ka), D(Kb), . . . , D(Kp) of the black patch images T(Ka), T(Kb), . . . , T(Kp).

In step S110, the CPU 128 determines whether the densities D(Yx), D(Mx), D(Cx), and D(Kx) detected in step S109 are predetermined densities. The predetermined densities are densities corresponding to image signal levels forming the patch images T(Yx), T(Mx), T(Cx), and T(Kx) for the color components.

If the detected densities D(Yx), D(Mx), D(Cx), and D(Kx) are not the predetermined densities (NO in step S110), the processing proceeds to step S111. In step S111, the CPU 128 changes the image forming condition, and then the processing returns to step S106. In step S111, the CPU 128 stores the changed image forming condition in the RAM 132.

The CPU 128 repeats steps S106 to S111, to specify an image forming condition under which the densities D(Yx), D(Mx), D(Cx), and D(Kx) are the predetermined densities.

On the other hand, if the densities D(Yx), D(Mx), D(Cx), and D(Kx) are the predetermined densities (YES in step S110), the processing proceeds to step S112. In step S112, the CPU 128 determines that an image forming condition for forming an image having a predetermined density is specified, and sets the count value n to zero, and then the processing proceeds to step S105.

A case where the CPU 128 determines that the copy start signal is not input from the operation unit 101 in step S101 will be described below.

If the copy start signal is not input from the operation unit 101 (NO in step S101), the processing proceeds to step S113. In step S113, the CPU 128 determines whether there is a request to update the first data.

More specifically, the CPU 128 determines whether a signal for performing processing for correcting the first data is input from the operation unit 101. If the signal for performing processing for correcting the first data is not input (NO in step S113), the CPU 128 determines that there is no instruction to update the first data, and then the processing returns to step S101.

If the signal for performing processing for correcting the first data is input (YES in step S113), the processing proceeds to step S114. In step S114, the CPU 128 causes the printer unit 100B to form the patch images T(Yx), T(Mx), T(Cx), and T(Kx) using the image forming condition stored in the ROM 130.

In step S115, the CPU 128 then irradiates light from the laser oscillator 201, measures a voltage output from the line sensor 204, and specifies the light receiving position differences ΔP(Yx), ΔP(Mx), ΔP(Cx), and ΔP(Kx) for the patch images T(Yx), T(Mx), T(Cx), and T(Kx). The light receiving position differences ΔP(Yx), ΔP(Mx), ΔP(Cx), and ΔP(Kx) specified in step S115 are respectively associated with density levels and stored in the RAM 132.

In step S116, the CPU 128 then transfers the patch images T(Yx), T(Mx), T(Cx), and T(Kx) onto the recording material P, and outputs the patch images to the sheet discharge tray 75. The recording material P, on which the patch images T(Yx), T(Mx), T(Cx), and T(Kx) have been transferred, is referred to as a test chart.

The CPU 128 causes the printer unit 100B to form the patch images T(Yx), T(Mx), T(Cx), and T(Kx) using the image forming condition stored in the ROM 130. At this time, the patch images T(Yx), T(Mx), T(Cx), and T(Kx) for the respective color components are transferred onto one recording material P not to overlap one another.

More specifically, the yellow patch image T(Yx), the magenta patch image T(Mx), the cyan patch image T(Cx), and the black patch image (Kx) are spaced a predetermined distance apart from one another in a direction perpendicular to a rotational direction (C direction) of the intermediate transfer belt 51. The patch images T(Yx), T(Mx), T(Cx), and T(Kx) are transferred and fixed onto the recording material P so that a test chart is formed.

The test chart is not limited to a configuration in which the patch images T(Yx), T(Mx), T(Cx), and T(Kx) for the color components are transferred onto the one recording material P. The patch image corresponding to the one color component may be transferred onto the one recording material P.

In step S117, the CPU 128 then causes the display unit 102 to display a guidance for reading the test chart. At this time, a description that the test chart is read is displayed on the display unit 102.

In step S118, the CPU 128 then waits until a reading start signal is input from the operation unit 101. In the present exemplary embodiment, when the user lays the test chart on a predetermined position of the document positioning glass 81, and presses the start button in the operation unit 101, the reading start signal is input from the operation unit 101 to the CPU 128.

If the reading start signal is input from the operation unit 101 (YES in step S118), the processing proceeds to step S119. In step S119, the CPU 128 causes the reader unit 100A to read the test chart, and detects the densities of the patch images T(Yx), T(Mx), T(Cx), and T(Kx).

The CPU 128 causes the image scanning unit 86 to scan the test chart, to cause the full color sensor 84 to receive lights respectively reflected from the patch images T(Yx), T(Mx), T(Cx), and T(Kx).

The full color sensor 84 acquires, when it receives the lights reflected from the patch images T(Yx), T(Mx), T(Cx), and T(Kx), image signals corresponding to the densities of the patch images (Yx), T(Mx), T(Cx), and T(Kx) from intensities of the reflected lights. The CPU 128 converts the acquired image signals into densities, to detect the densities D(Yx), D(Mx), D(Cx), and D(Kx) of the patch images.

Even if the toner charge amount changes and the toner height of the patch image changes, the intensity of the light reflected from the patch image does not change. Therefore, in the present exemplary embodiment, when the reader unit 100A reads the patch image, which has been transferred and fixed onto the recording material P, to correct the first data, the density of the patch image is detected based on the intensity of the light reflected from the patch image.

In step S120, the CPU 128 then refers to the second data from the densities D(Yx), D(Mx), D(Cx), and D(Kx) detected in step S119, and converts the second data into amounts of adhered toner $Q_D$(Yx), $Q_D$(Mx), $Q_D$(Cx), and $Q_D$(Kx). The amounts of adhered toner $Q_D$(Yx), $Q_D$(Mx), $Q_D$(Cx), and $Q_D$(Kx) are amounts of adhered toner to the patch images having the densities D(Yx), D(Mx), D(Cx), and D(Kx).

In step S121, the CPU 128 then updates the first data from the amounts of adhered toner $Q_D(Yx)$, $Q_D(MX)$, $Q_D(Cx)$, and $Q_D(Kx)$ obtained in step S120 and the light receiving position differences ΔP(Yx), ΔP(Mx), ΔP(Cx), and ΔP(Kx) detected in step S115.

The CPU 128 corrects the first data by replacing the amounts of adhered toner corresponding to the light receiving position differences ΔP(Yx), ΔP(Mx), ΔP(Cx), and ΔP(Kx) stored in the RAM 132 with the amounts of adhered toner $Q_D(Yx)$, $Q_D(Mx)$, $Q_D(Cx)$, and $Q_D(Kx)$ obtained in step S120.

In the present exemplary embodiment, 16 amounts of adhered toner $Q_D(Yx)$ are detected from the yellow patch image T(Yx). Therefore, the amounts of yellow adhered toner corresponding to all densities at 256 gray levels are obtained by linear interpolation of the 16 amounts of adhered toner $Q_D(Yx)$.

By similar methods, the amounts of magenta adhered toner corresponding to all the densities at 256 gray levels, the amounts of cyan adhered toner corresponding to all the densities at 256 gray levels, the amounts of black adhered toner corresponding to all the densities at 256 gray levels are obtained. The updated first data for each of the color components is stored in the RAM 132.

In step S121, the CPU 128 then performs, after correcting the first data, density control processing using the corrected first data. The density control processing is performed using the patch image for each of the color components, so that an image forming condition for forming the toner image for the color component at a predetermined density is determined.

In step S122, the CPU 128 causes the printer unit 100B to form the patch images T(Yx), T(Mx), T(Cx), and T(Kx) again using the image forming condition stored in the RAM 132.

In step S123, the CPU 128 irradiates light from the laser oscillator 201, measures a voltage output from the line sensor 204, and specifies the light receiving position differences ΔP(Yx), ΔP(Mx), ΔP(Cx), and ΔP(Kx) for the respective patch images.

In step S124, the CPU 128 then refers to the first data corrected in step S121 from the light receiving position differences ΔP(Yx), ΔP(Mx), ΔP(Cx), and ΔP(Kx) specified in step S123, to detect amounts of adhered toner Q(Yx), Q(Mx), Q(Cx), and Q(Kx).

In step S125, the CPU 128 then refers to the second data stored in the RAM 132 from the amounts of adhered toner Q(Yx), Q(Mx), Q(Cx), and Q(Kx) detected in step S124, to detect the densities D(Yx), D(Mx), D(Cx), and D(Kx).

In step S126, the CPU 128 then determines whether the densities D(Yx), D(Mx), D(Cx), and D(Kx) detected in step S125 are predetermined densities. The predetermined densities are densities corresponding to image signal levels at which the patch images T(Yx), T(Mx), T(Cx), and T(Kx) for the color components are formed.

If the densities D(Yx), D(Mx), D(Cx), and D(Kx) detected in step S125 are not the predetermined densities (NO in step S126), the processing proceeds to step S127. In step S127, the CPU 128 changes the image forming condition, and then the processing returns to step S122. In step 127, the CPU 128 stores the changed image forming condition in the RAM 132.

The CPU 128 repeats the processing in steps S122 to S127, to specify an image forming condition under which the densities D(Yx), D(Mx), D(Cx), and D(Kx) are the predetermined densities.

On the other hand, if the densities D(Yx), D(Mx), D(Cx), and D(Kx) are the predetermined densities (YES in step S126), the CPU 128 determines that an image forming condition for forming an image having a predetermined density is specified, and then the processing returns to step S100.

The basic configuration of a second exemplary embodiment is the same as that of the first exemplary embodiment. Therefore, the same or substantially the same components as those in the first exemplary embodiment are assigned the same reference numerals, and hence the detailed description thereof is omitted. Hereinbelow, characteristic parts of the present exemplary embodiment will be described.

Figure 8:
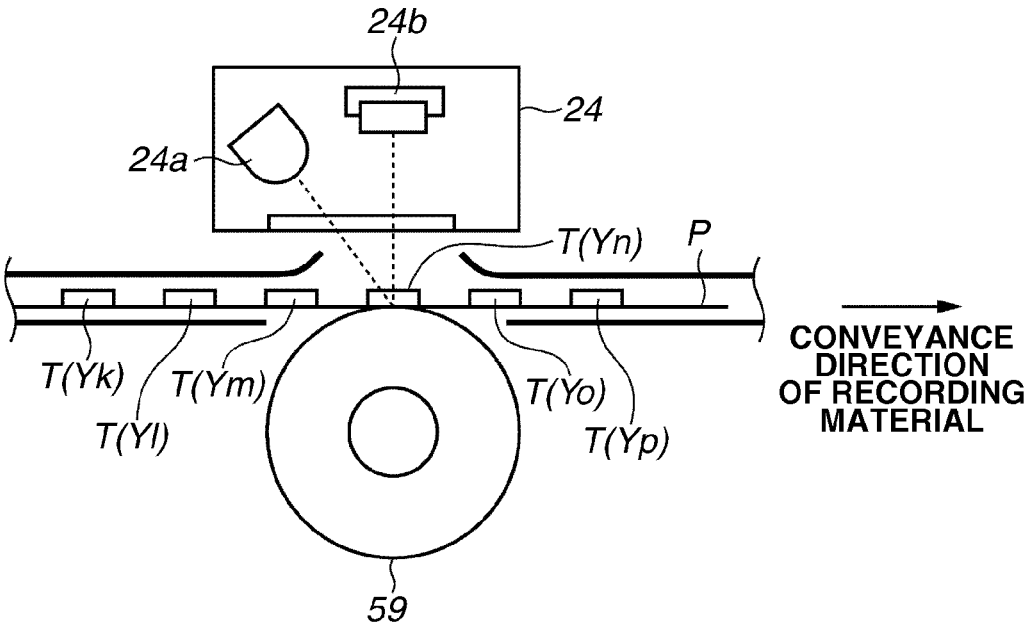
FIG. 8 is a schematic view illustrating a principal part of an image density sensor according to a second exemplary embodiment.

An image forming apparatus according to the present exemplary embodiment includes an image density sensor 24. The image density sensor 24 measures an image density of an image fixed onto a recording material P in the process of the recording material P being conveyed on a two-sided conveyance path 79, as illustrated in FIG. 1. FIG. 8 is a schematic sectional view of the vicinity of the image density sensor 24 according to the present exemplary embodiment and the recording material P. The image density sensor 24 includes a light emitting diode (LED) 24*a* and an image sensor 24*b*.

The LED 24*a* includes an LED for irradiating white light, and irradiates the recording material P conveyed on the two-sided conveyance path 79 with the white light. The image sensor 24*b* includes a charge coupled device (CCD) provided with an RGB (Red, Green, Black) color filter, and receives the light irradiated by the LED 24*a* and reflected from a patch image, which has been transferred onto the recording material P, to detect a density of the patch image. Therefore, in the present exemplary embodiment, the image density sensor 24 functions as a second detection unit.

A method for detecting, from a recording material P on which a yellow patch image T(Yx) has been fixed, a density of the yellow patch image T(Yx) will be described below with reference to a schematic sectional view of the image forming apparatus 100 illustrated in FIG. 1. A method for detecting densities of a magenta patch image T(Mx), a cyan path image T(Cx), and a black patch image T(Kx) is similar to that for detecting the density of the yellow patch image T(Yx), and hence the description thereof is not repeated.

The recording material P, on which the yellow patch image T(Yx) has been fixed, passes through a paper conveyance path, which is irradiated with light by the LED 24*a* in the image density sensor 24, via the two-sided conveyance path 79 after being guided to a reversing path 77 by a first switching guide 76 and being reversed by a reversing roller 78.

Thus, the light reflected from the yellow patch image T(Yx) is received in the image sensor 24*b*. At this time, the reversing path 77 and the reversing roller 78 reverse the recording material P. Therefore, the front and the back in a conveyance direction of the yellow path image T(Tx) borne by the recording material P are reversed. Therefore, the image density sensor 24 detects densities D(Yp), D(Yo), . . . , D(Yb), D(Ya) of the patch image in this order.

The image sensor 24*b* can detect, when it receives the reflected light from the yellow patch image T(Yx), the density from the intensity of the reflected light, similar to the full-color sensor 84 described in the first exemplary embodiment.

A CPU 128 replaces an amount of adhered toner corresponding to a light receiving position difference ΔP(Yx) measured by a toner height sensor unit 21 with an amount of adhered toner $Q_D(Yx)$ detected by the image density sensor 24, to correct first data.

In the present exemplary embodiment, the density of a patch image can be detected before a recording material P, on which the patch image has been fixed, is discharged out of the image forming apparatus 100. Therefore, time and load for a user to lay a test chart on a reader unit 100A and cause the reader unit 100A to perform reading are saved.

If the image density sensor 24 according to the present exemplary embodiment is used, an image forming apparatus having no reader unit 100A can also control an image forming condition, and can form an image superior in gradation even when a toner charge amount changes.

While the second exemplary embodiment is configured so that the processing for correcting the first data is started when the user inputs a signal for performing processing for correcting the first data from an operation unit 101, similar to the first exemplary embodiment, the present invention is not limited to this configuration. In the second exemplary embodiment, the processing for correcting the first data may be started when an absolute humidity in the image forming apparatus 100, which has been measured by an environment sensor 13, varies by a predetermined value or more. A predetermined value may be 2 $g/m^3$, for example.

In the first exemplary embodiment and the second exemplary embodiment, the laser oscillator 201 in the toner height sensor unit 21 irradiates the intermediate transfer belt 51 with measuring light, and a light receiving position difference is detected from a patch image that passes through an irradiation position, which is irradiated with the measuring light. However, an arrangement of the toner height sensor unit 21 is not limited to this.

A toner height sensor unit 22 (FIG. 1) for irradiating a recording material P, on which a patch image before fixing is transferred, with measuring light may be used. In this configuration, the toner height sensor unit 22 measures a light receiving position of light reflected from the recording material P, and measures a light receiving position of light reflected from a patch image transferred onto the recording material P.

A toner height sensor unit 23 for irradiating a patch image formed on a photosensitive drum 1 with measuring light may be used. In this configuration, the toner height sensor unit 23 measures a light receiving position of light reflected from the photosensitive drum 1, and measures a light receiving position of light reflected from a patch image formed on the photosensitive drum 1.

The first exemplary embodiment and the second exemplary embodiment have first data representing a correspondence relationship between a light receiving position difference and an amount of adhered toner, and second data representing a correspondence relationship between an amount of adhered toner and a density. However, the first exemplary embodiment and the second exemplary embodiment may have data, representing a correspondence relationship between a light receiving position difference and density, obtained by combining the first data and the second data.

In this configuration, the data representing a correspondence relationship between a light receiving position difference and density may be corrected based on a light receiving position difference specified by the toner height sensor unit 21 and the density of a patch image detected by the reader unit 100A or the image density sensor 24.

According to the first exemplary embodiment and the second exemplary embodiment, even if a toner charge amount changes, an amount of adhered toner corresponding to a predetermined density can be specified so that an image having an appropriate density can be output.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-033851 filed Feb. 18, 2010, which is hereby incorporated by reference herein in its entirety.

What is claimed is:

1. An image forming apparatus comprising:

an image forming unit configured to form a toner image on an image bearing member;

a first detection unit configured to detect a height of the toner image formed according to a predetermined image forming condition by the image forming unit, the height of the toner image being a height in a direction perpendicular to a surface of the image bearing member;

a determination unit configured to determine an image forming condition of the image forming unit according to a detection result of the first detection unit;

a second detection unit configured to detect a density of the toner image formed according to a predetermined image forming condition by the image forming unit; and a correction unit configured to correct the image forming condition of the image forming unit determined by the determination unit based on the density of the toner image detected by the second detection unit.

2. The image forming apparatus according to claim 1, wherein the first detection unit includes an irradiation unit configured to irradiate the image bearing member with light, and a light receiving unit configured to receive the light, on a light receiving surface of the light receiving unit, irradiated by the irradiation unit and reflected from the toner image, the first detection unit outputting a signal corresponding to the height of the toner image based on a result of receiving the light by the light receiving unit.

3. The image forming apparatus according to claim 2, wherein the light receiving unit receives the light irradiated by the irradiation unit and reflected from the image bearing member to output a first signal, and receives the light irradiated by the irradiation unit and reflected from the toner image to output a second signal, and wherein the first detection unit outputs a signal corresponding to the height of the toner image based on a difference between the first signal and the second signal, which are output by the light receiving unit.

4. The image forming apparatus according to claim 3, wherein the first signal represents a light receiving position at which the light irradiated by the irradiation unit and reflected from the image bearing member is received on the light receiving surface, and the second signal represents a light receiving position at which the light irradiated by the irradiation unit and reflected from the toner image is received on the light receiving surface, and wherein the first detection unit outputs the signal corresponding to the height of the toner image based on a difference between the light receiving positions specified from the first signal and the second signal, which are output by the light receiving unit.

5. The image forming apparatus according to claim 2, wherein the determination unit includes a storage unit configured to store data representing a correspondence relationship between the signal corresponding to the height of the toner image, which is output by the first detection unit, and a density of the toner image, wherein the determination unit determines the image forming condition of the image forming unit by referring to the data stored in the storage unit based on the signal corresponding to the height of the toner image, and wherein the correction unit corrects the data stored in the storage unit based on the density of the toner image detected by the second detection unit, to correct the image forming condition of the image forming unit determined by the determination unit.

6. The image forming apparatus according to claim 2, wherein the determination unit includes a storage unit configured to store first data representing a correspondence relationship between the signal corresponding to the height of the toner image and an amount of adhered toner to the toner image, and a second data representing a correspondence relationship between the amount of adhered toner and a density of the toner image;

wherein the second detection unit detects density of a toner image transferred onto a recording material by the image forming unit, the toner image being formed according to an image forming condition under which the height of the toner image is specified, and wherein the correction unit corrects the first data stored in the storage unit based on the amount of adhered toner to the toner image specified by referring to the second data stored in the storage unit from the density of the toner image detected by the second detection unit, to correct the image forming condition of the image forming unit determined by the determination unit.

7. The image forming apparatus according to claim 1, wherein the second detection unit detects the density of the toner image based on a light amount of the light reflected from the toner image.

8. The image forming apparatus according to claim 1, wherein the toner image whose density is detected by the second detection unit is formed under the same image forming condition as the toner image whose height is detected by the first detection unit.

9. The image forming apparatus according to claim 1, wherein the toner image whose density is detected by the second detection unit is a toner image whose height is detected by the first detection unit.

* * * * *